US009207035B2

(12) United States Patent
Schexnayder

(10) Patent No.: US 9,207,035 B2
(45) Date of Patent: Dec. 8, 2015

(54) TOY FIREARM FOR DISPENSING CHARTACEOUS OBJECTS

(71) Applicant: Michael Lee Schexnayder, Iowa, LA (US)

(72) Inventor: Michael Lee Schexnayder, Iowa, LA (US)

( * ) Notice: Subject to any disclaimer, the term of this patent is extended or adjusted under 35 U.S.C. 154(b) by 0 days.

(21) Appl. No.: 14/283,481

(22) Filed: May 21, 2014

(65) Prior Publication Data

US 2014/0345586 A1 Nov. 27, 2014

Related U.S. Application Data

(60) Provisional application No. 61/825,683, filed on May 21, 2013.

(51) Int. Cl.
*F41B 4/00* (2006.01)

(52) U.S. Cl.
CPC ..... *F41B 4/00* (2013.01)

(58) Field of Classification Search
CPC ..... A63H 33/18; F41B 4/00; F41B 7/08
See application file for complete search history.

(56) References Cited

U.S. PATENT DOCUMENTS

| | | | | |
|---|---|---|---|---|
| 6,068,157 | A * | 5/2000 | Kamiya | 221/36 |
| 2006/0046613 | A1* | 3/2006 | Mann | 446/475 |
| 2006/0175344 | A1* | 8/2006 | Skarda et al. | 221/258 |
| 2008/0142540 | A1* | 6/2008 | Chang | 221/259 |
| 2009/0302048 | A1* | 12/2009 | Nobilet et al. | 221/1 |
| 2014/0165985 | A1* | 6/2014 | Bryngelson | 124/82 |
| 2014/0217111 | A1* | 8/2014 | Sampson et al. | 221/1 |

* cited by examiner

*Primary Examiner* — John Ricci

(57) ABSTRACT

A toy firearm for dispensing chartaceous objects includes a handgun-shaped casing, a front chamber, a dispensing mechanism, a trigger, and a retaining mechanism. The chartaceous objects are inserted into the front chamber so that the retaining mechanism can function as a spring loaded clip to secure the chartaceous objects within the front chamber. The dispensing mechanism allows the users to launch each of the chartaceous objects over a greater distance as the dispensing mechanism is selectively operated from an off-position to an on-position by the use of the trigger.

18 Claims, 11 Drawing Sheets

TOY FIREARM FOR DISPENSING CHARTACEOUS OBJECTS

The current application claims a priority to the U.S. Provisional Patent application Ser. No. 61/825,683 filed on May 21, 2013.

FIELD OF THE INVENTION

The present invention relates generally to chartaceous objects dispensing devices. More specifically, the present invention is a motorized toy firearm that is utilized to project paper bills or other similar material over large distances.

BACKGROUND OF THE INVENTION

Throwing money, confetti, or other related chartaceous objects over large distances is difficult due to many different reasons; such as weight of the material, surface area of the material, and environmental elements. For example, throwing wadded paper bills of money at an exotic dancer on stage is a widely accepted method of delivering tips in an attempt to coerce the dancer into removing an article of clothing as part of their stage act. However, the low mass and high surface area of the paper bills makes it difficult for one to toss the bills a sufficient distance to reach the stage. A paper bill that is traveling through the air towards the stage experiences significant drag due to the low mass and high surface area. As a result, tossed paper bills are likely to fall short of the stage and become lost. This is particularly troublesome if the person throwing the bills is not close to the stage, a likely scenario in a crowded venue. The present invention seeks to address the aforementioned issues and provides users with a convenient, straightforward, and functional solution to launch chartaceous objects over large distances.

The present invention is a toy firearm that holds the chartaceous objects prior to launching the chartaceous objects over large distances. In its preferred embodiment, the present invention comprises a handgun shaped toy firearm. The toy firearm features a self-contained battery pack that supplies power to a small electric motor that is engaged by pulling the trigger of the toy firearm. The motor protrudes into an elongated slot located along the barrel of the toy firearm. The exposed exterior surface of the electric motor features a rubberized grip. A spring loaded clip is located within the elongated slot of the toy firearm. In its relaxed state, the spring loaded clip rests on the exposed exterior surface of the electric motor. The spring loaded clip is used to secure the chartaceous objects within the elongated slot by placing the chartaceous objects between the spring loaded clip and the electric motor. This loads the spring loaded clip and securely holds the chartaceous objects against the electric motor. When the toy firearm is activated through a trigger, the electric motor rotates, causing the rubberized grip of the motor to engage the surface of the chartaceous objects and project the chartaceous objects out of the front of the toy firearm. The present invention is available in multiple configurations relating to the possible selective fire modes of the toy firearm. For example, the toy firearm may launch paper bills one at a time with each pull of the trigger in a semiautomatic configuration. Alternatively, the electric motor may continuously rotate as the trigger is held down in order to continuously launch the paper bills in a fully automatic configuration. A final possible configuration may allow several paper bills to be rapidly launched sequentially in a burst fire configuration.

The object of the present invention is to provide users with a means of launching chartaceous objects over a greater distance than physically throwing allows. As a large number of chartaceous objects may be stacked within the elongated slot of the toy firearm, the present invention allows users to rapidly launch a large number of chartaceous objects in a very short time span.

DETAIL DESCRIPTIONS OF THE INVENTION

Figure 1:
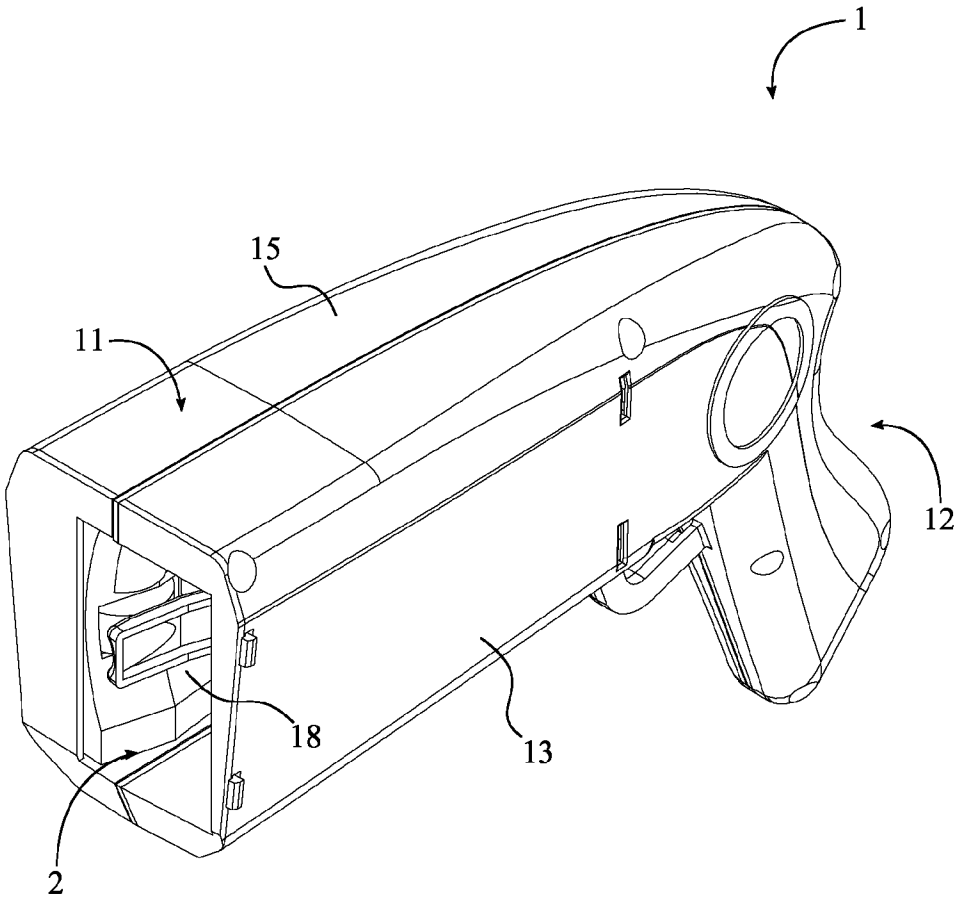
FIG. 1 is a first perspective view of the present invention.

All illustrations of the drawings are for the purpose of describing selected versions of the present invention and are not intended to limit the scope of the present invention.

The present invention is a toy firearm that is utilized to launch or dispense a plurality of chartaceous objects over large distances. The chartaceous objects used within the present invention can be a plurality of paper bills, a plurality of printed papers, a plurality of confetti, and any other similar chartaceous materials that needs to be launched over a large distance. In its preferred embodiment, the present invention comprises a handgun shaped shell so that the remaining components of the present invention can be contained within the handgun shaped shell. More specifically, the present invention comprises a handgun-shaped casing 1, a front chamber 2, a dispensing mechanism 3, a trigger 4, and a retaining mechanism 5. In reference to FIG. 1, FIG. 2, and FIG. 3, the general configuration of the present invention, the front chamber 2 is traversed into the handgun-shaped casing 1 creating an elongated slot, and the dispensing mechanism 3 is positioned within the handgun-shaped casing 1 where the dispensing mechanism 3 selectively operates in between an on-position and an off-position through the trigger 4. The retaining mechanism 5, which secures the stored chartaceous objects within the front chamber 2, is adjacently positioned within the front chamber 2. In order to operate the present invention, the users have to manually load the chartaceous objects into the front chamber 2 through an opening of the front chamber 2. Since the trigger 4 is able operate the dispensing mechanism 3 in between the off-position and the on-position, the users can launch or dispense the chartaceous objects from the front chamber 2 by pressing the trigger 4.

Figure 2:
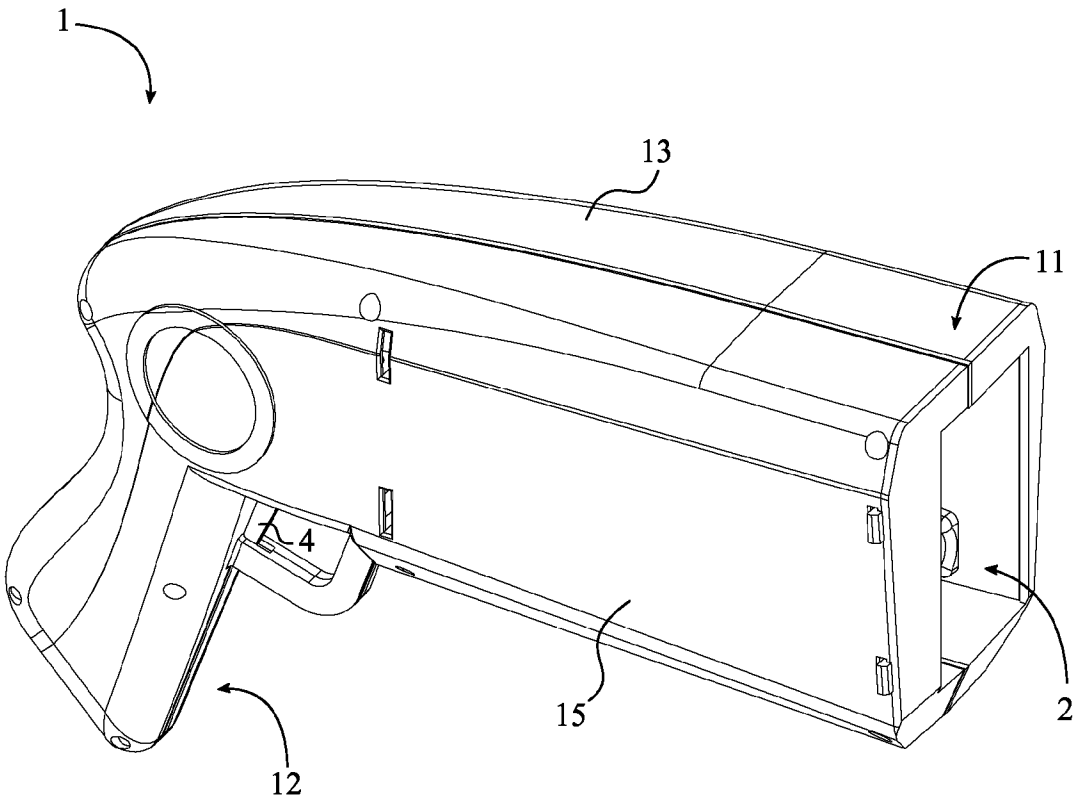
FIG. 2 is a second perspective view of the present invention.
Figure 3:
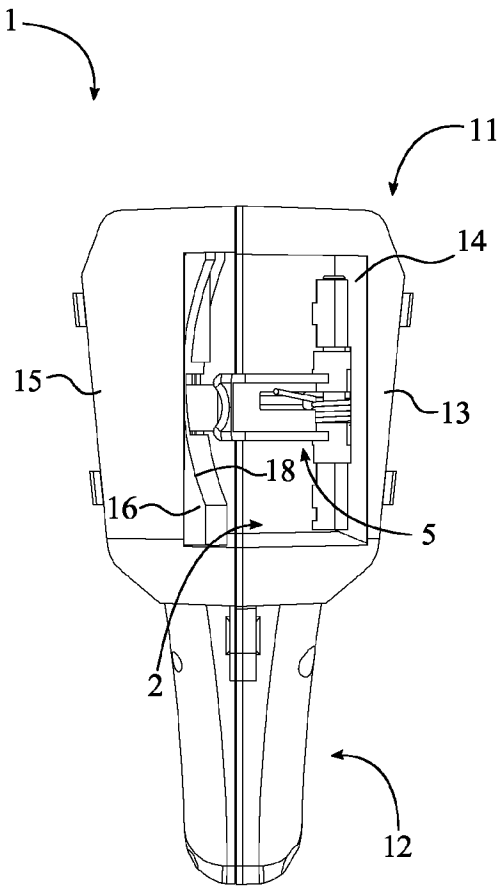
FIG. 3 is a front view of the present invention.
Figure 7:
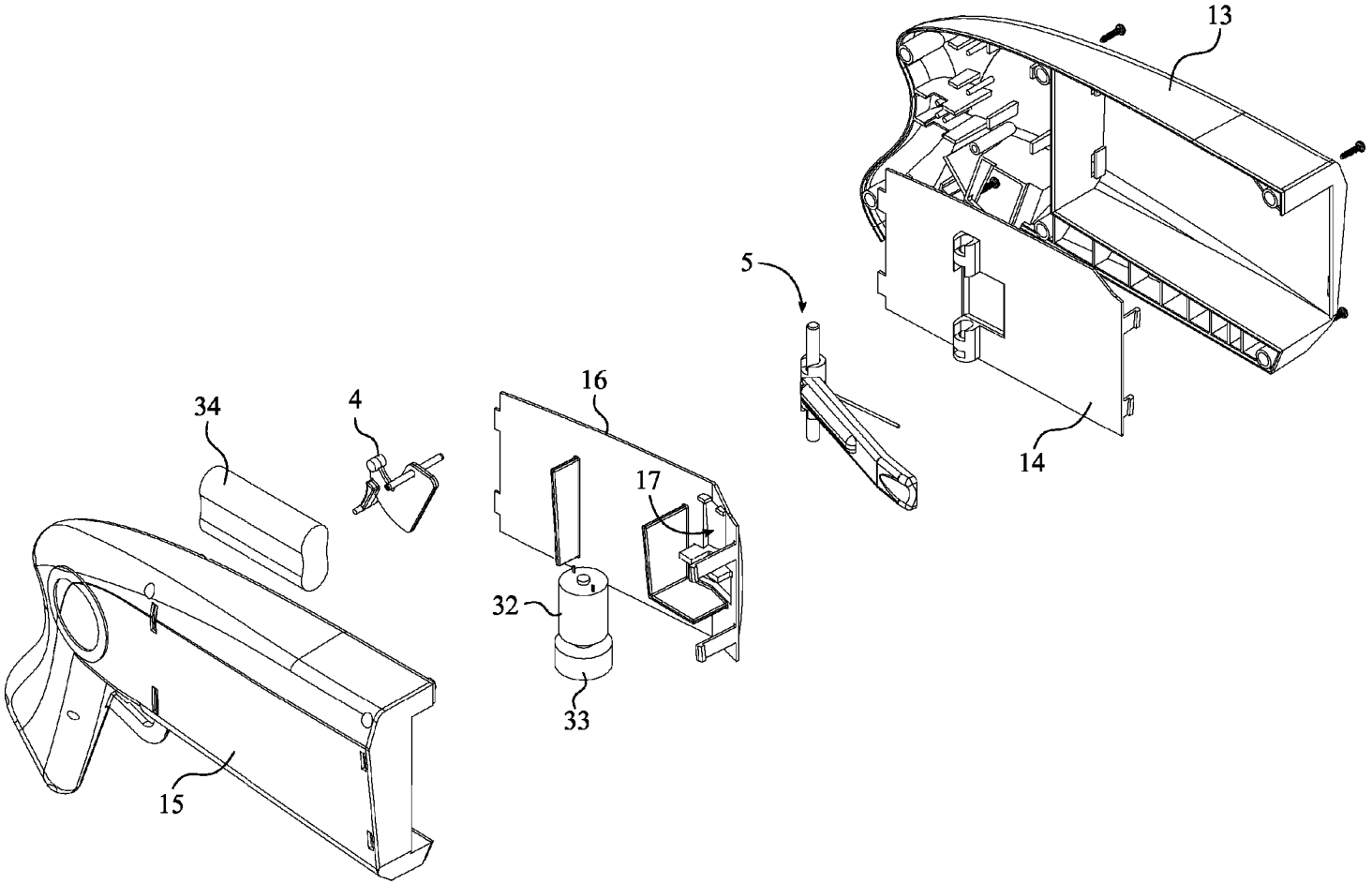
FIG. 7 is an exploded view of the present invention.

In reference to FIG. 1, FIG. 2, and FIG. 7, the handgun-shaped casing 1 comprises a left outer casing 13, a left inner plate 14, a right outer casing 15, and a right inner plate 16. The left inner plate 14 is connected to the left outer casing 13 so that the left side of the handgun-shaped casing 1 can be formed. Similarly, the right inner plate 16 is connected to the right outer casing 15 so that the right side of the handgun-shaped casing 1 can be formed. The left outer casing 13 and the right outer casing 15 are attached to each other in such a way that the left outer casing 13 and the right outer casing 15 complete the handgun-shaped casing 1 while the left inner plate 14 is adjacently positioned with the right inner plate 16. Even though the preferred embodiment of the present invention utilizes a plurality of screw fasteners as the attachment means in between the left outer casing 13 and the right outer casing 15, the present invention is not limited to the plurality of screw fasteners and can use any other type of attachment means. Additionally, the left outer casing 13 and the right outer casing 15 each comprises a barrel portion 11 and a handle portion 12, where the handle portions 12 allow the users to hold the present invention while the barrel portions 11 point toward the target area or the target object.

Figure 10:
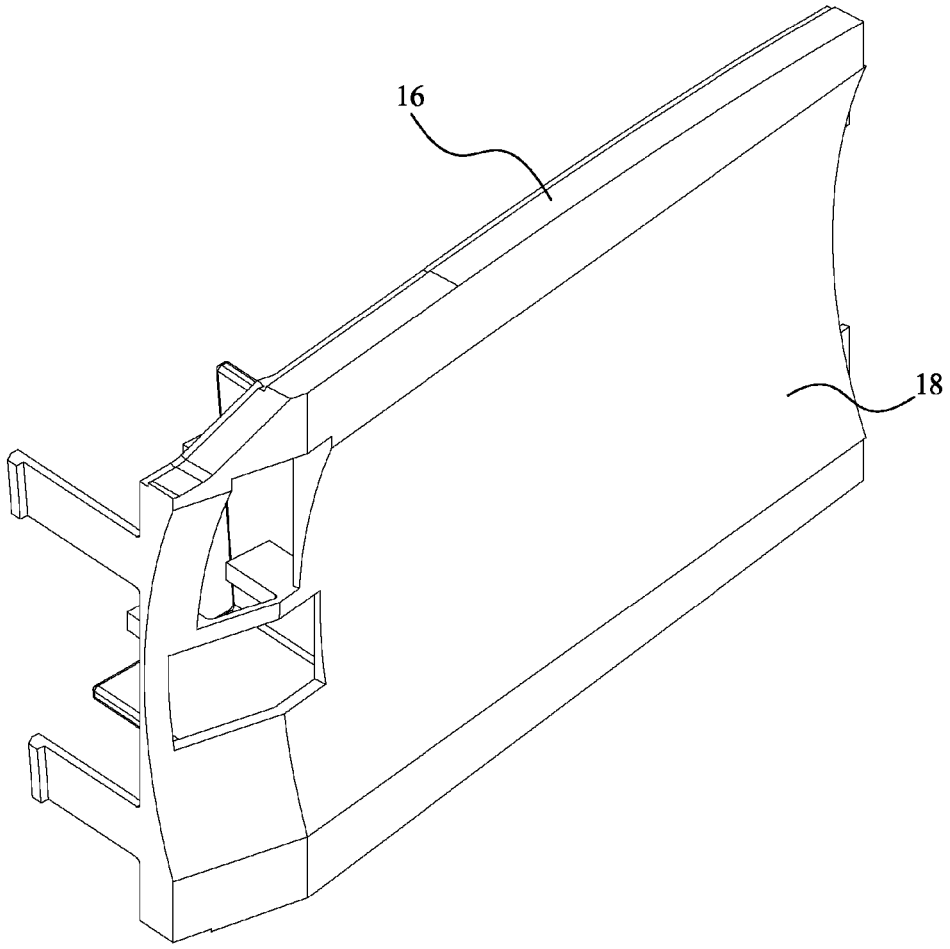
FIG. 10 is a perspective view of the right inner plate of the present invention, showing the concave outer surface.

In reference to FIG. 1, and FIG. 10, the preferred embodiment of the present invention, the right inner plate 16 comprises a concave outer surface 18 and a flat inner surface, where the concave outer surface 18 and the flat inner surface are oppositely positioned from each other along the right inner plate 16. More specifically, the flat inner surface is adjacently positioned with the inside surface of the right outer casing 15, and the concave outer surface 18 is adjacently positioned with the left inner plate 14. Even though the preferred embodiment comprises the flat inner surface on the right inner plate 16, the inside surface of the right inner plate 16 can be shaped into a convex surface, a concave surface, or any other geometric shaped surface within the present invention.

The front chamber 2 that holds the chartaceous objects are generally positioned in between the left inner plate 14 and the right inner plate 16. More specifically, the front chamber 2 extends along the barrel portions 11 so that the chartaceous objects can be launched toward the target area or the target object through the opening. The front chamber 2 and the opening generally function as open components and are free of obstructions, where the length of the front chamber 2 is sufficient to horizontally stack the chartaceous objects within the front chamber 2. The trigger 4, which activates the dispensing mechanism 3, is pivotally connected to the handle portion 12 of the right outer casing 15 and the left outer casing 13 in such a way that the trigger 4 is centrally positioned in between the left outer casing 13 and the right outer casing 15.

Figure 5:
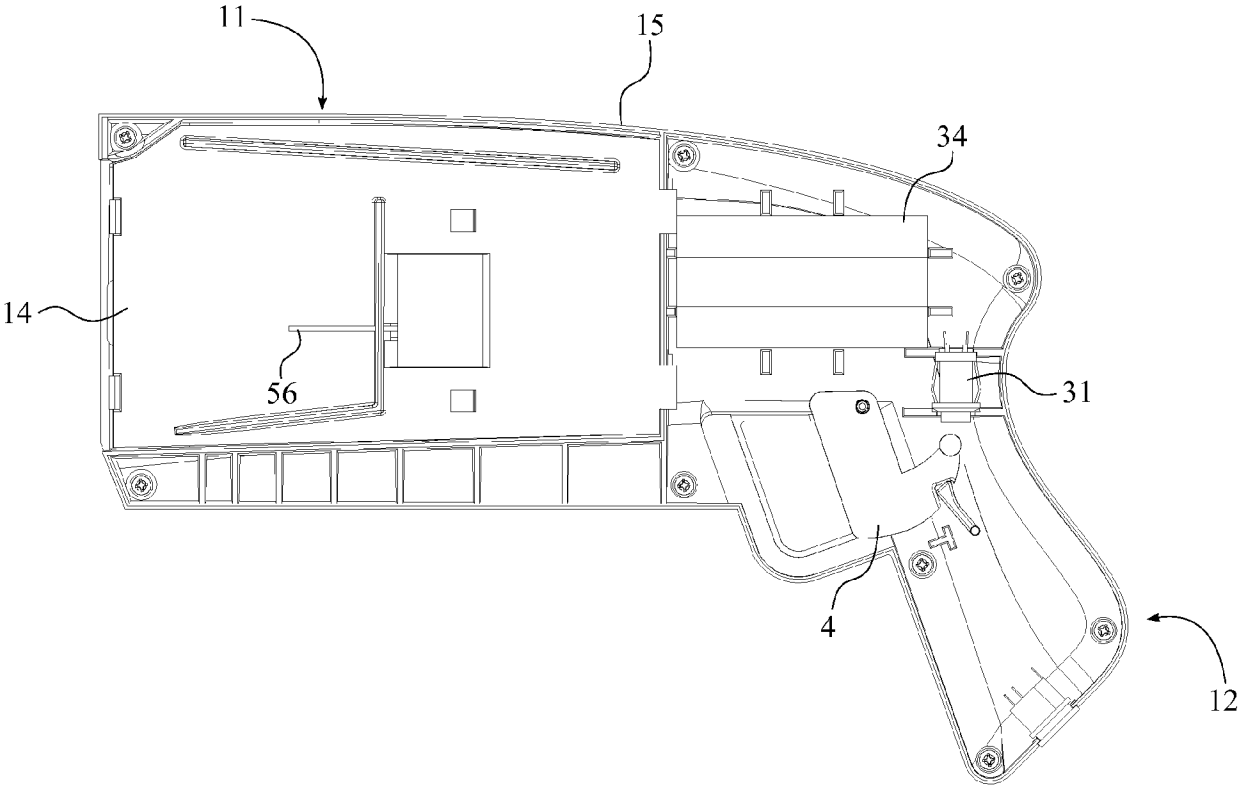
FIG. 5 is a side view of the present invention showing the off-position, wherein the left outer casing is removed from the present invention
Figure 6:
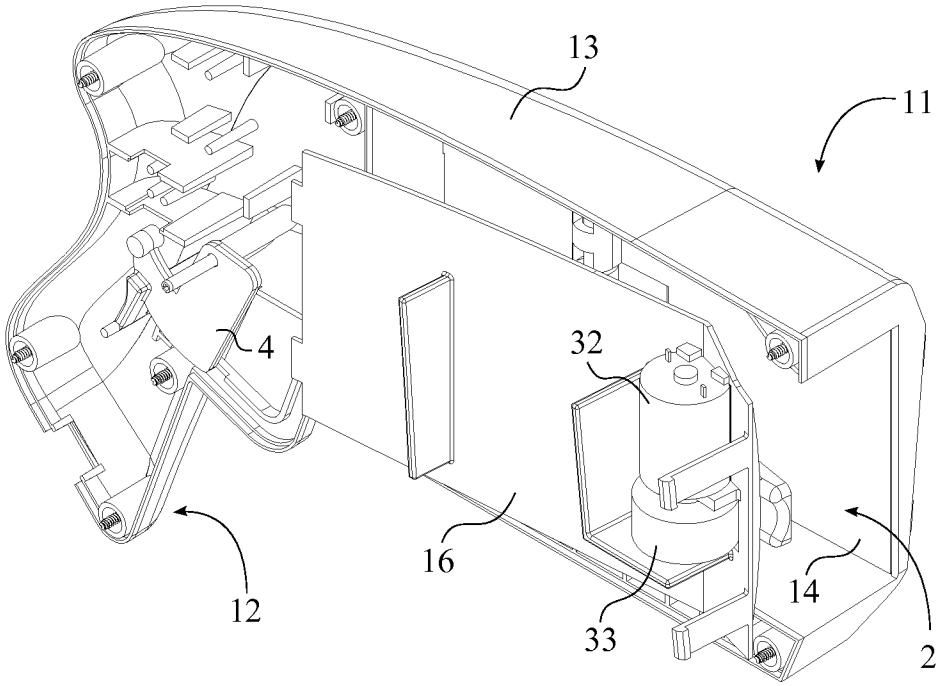
FIG. 6 is a perspective view of the present invention showing the motor and the grip wheel, wherein the right outer casing is removed from the present invention.
Figure 11:
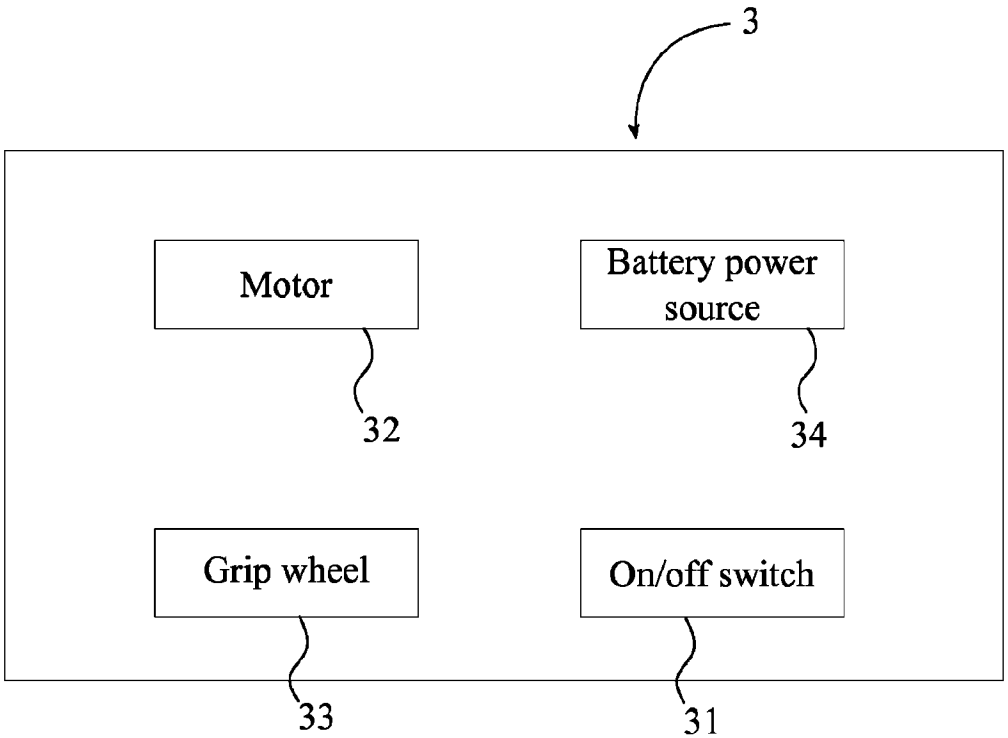
FIG. 11 is a diagram illustrating the components of the dispensing mechanism of the present invention.

In reference to FIG. 5, FIG. 6, and FIG. 11, the dispensing mechanism 3 comprises an on/off switch 31, a motor 32, a grip wheel 33, and a battery power source 34. The on/off switch 31 is connected to the handle portion 12 of the right outer casing 15, where the on/off switch 31 is adjacently positioned with the trigger 4. The on/off switch 31 is naturally positioned at the off-potion in order to optimize the safety and the efficiency of the present invention. The battery power source 34 is connected to the handle portion 12 of the right outer casing 15, where the battery power source 34 can be either a rechargeable lithium ion battery with a charging port or at least one disposable battery housed within a battery compartment. In the preferred embodiment of the present invention, the rechargeable lithium ion battery is utilized as the battery power source 34 so that the rechargeable lithium ion battery is able to produce the necessary electrical power required for the preferred embodiment. The motor 32 is connected to the barrel portion 11 of the right outer casing 15, where the motor 32 is positioned in between the right outer casing 15 and the right inner plate 16. The grip wheel 33 is axially connected with the motor 32 and extends into the front chamber 2 through a wheel opening 17 of the right inner plate 16. In order for the dispensing mechanism 3 to operate in between the on-position and the off-position, the on/off switch 31, the motor 32, and the battery power source 34 are electrically connected with each other through a circuitry.

Figure 12:
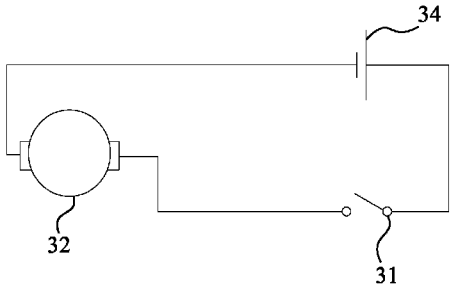
FIG. 12 is an electrical schematic illustrating the off-position of the present invention.

In reference to FIG. 5 and FIG. 12, the trigger 4 is extended from the handle portion 12 of the left outer casing 13 and the right outer casing 15 as the dispensing mechanism 3 is naturally positioned to be at the off-position. Due to the positioning of the trigger 4 with respect to the handle portions 12, the trigger 4 is also positioned away from the on/off switch 31 in such a way that the on/off switch 31 opens the circuitry. As a result, the dispensing mechanism 3 does not operate within the present invention.

Figure 4:
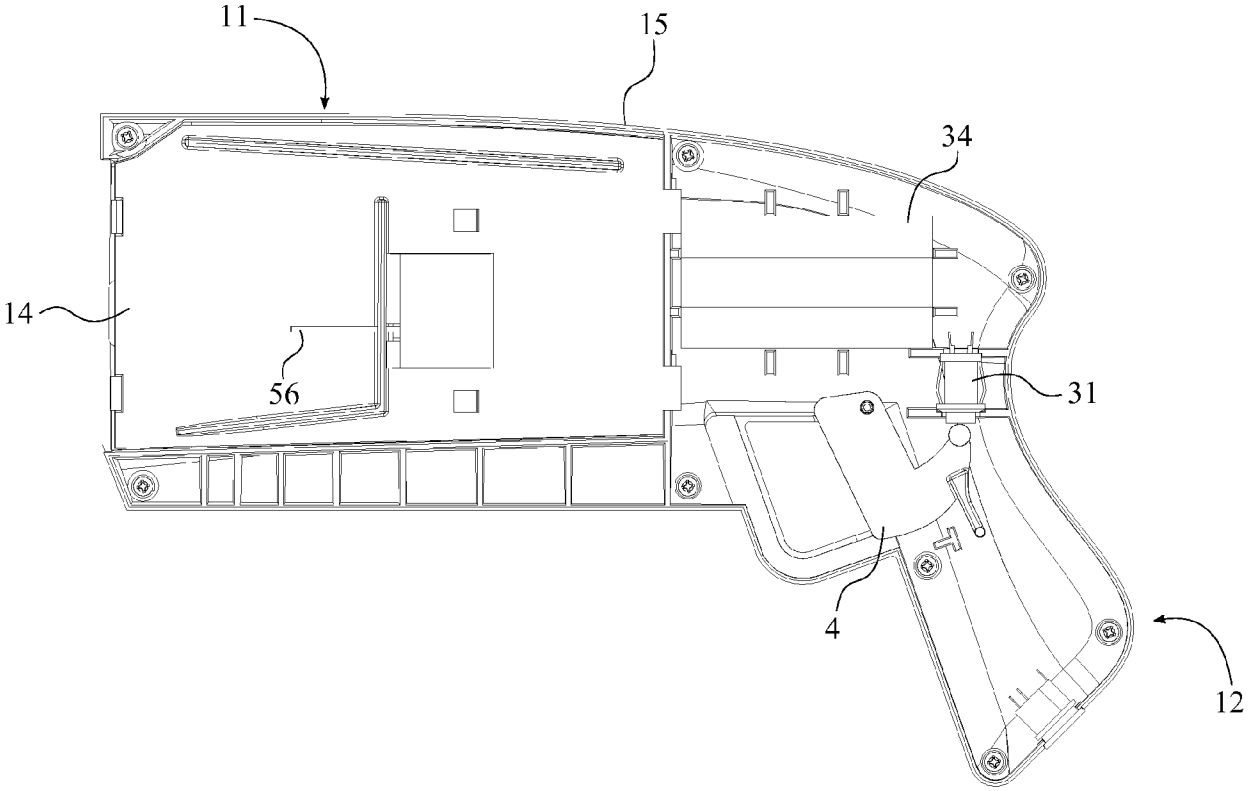
FIG. 4 is a side view of the present invention showing the on-position, wherein the left outer casing is removed from the present invention.
Figure 13:
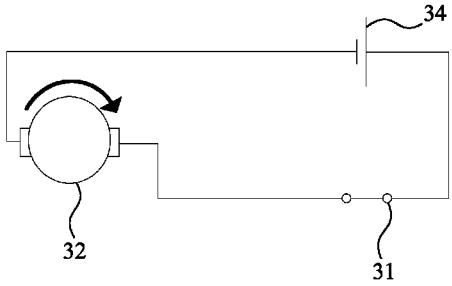
FIG. 13 is an electrical schematic illustrating the on-position of the present invention.

In reference to FIG. 4 and FIG. 13, if the users need to operate the dispensing mechanism 3, the users need to press the trigger 4 toward the handle portions 12 so that the dispensing mechanism 3 can be transformed into the on-position from the off-position. Once the trigger 4 is pressed by the users, the trigger 4 is positioned flush with the handle portion 12 of the left outer casing 13 and the right outer casing 15 in such a way that the positioning of the trigger 4 presses the on/off switch 31. Then the on/off switch 31 completes the circuitry and enables the dispensing mechanism 3 to operate within the present invention as long as the user is pressing the trigger 4.

Figure 8:
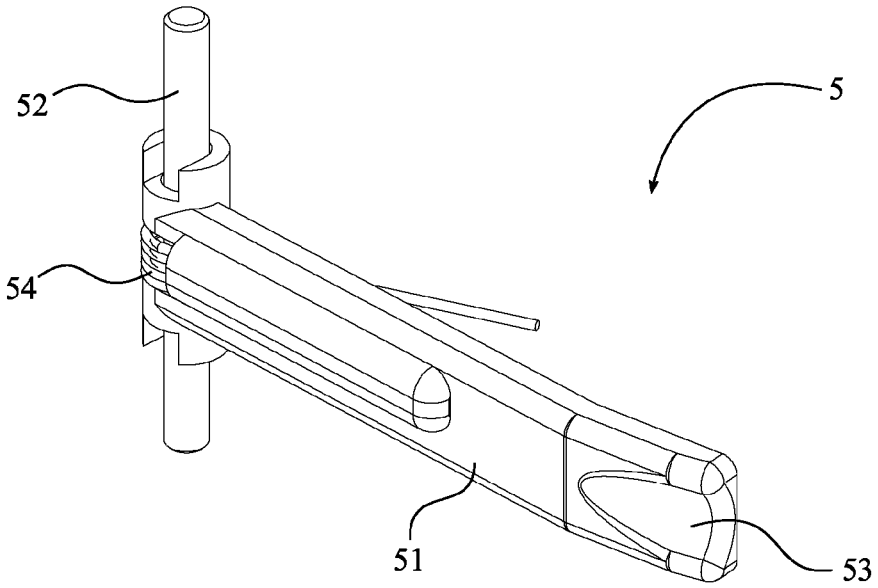
FIG. 8 is a first perspective view of the retaining mechanism of the present invention.
Figure 9:
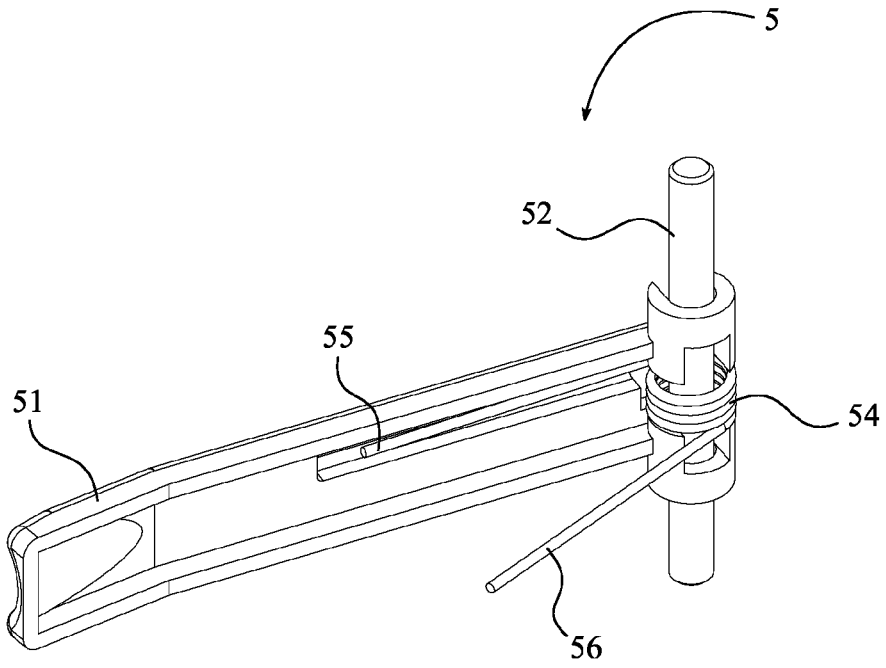
FIG. 9 is a second perspective view of the retaining mechanism of the present invention.

In reference to FIG. 8 and FIG. 9, the retaining mechanism 5 that functions as a spring 54 loaded clip for the stored chartaceous objects comprises a press plate 51, an indentation 53, and a spring 54. More specifically, the press plate 51 is hingedly connected with the left inner plate 14 through a connecting rod 52 so that the press plate 51 is able to freely rotate around the connecting rod 52. The spring 54 is perimetrically connected around the connecting rod 52 and positioned in between the press plate 51 and the left inner plate 14 in such a way that a first end of the spring 54 adjacently extends along the press plate 51 while a second end 56 of the spring 54 adjacently extends along the left inner plate 14. In its relaxed state, the spring 54 pushes the press plate 51 up against the right inner plate 16 so that the press plate 51 can be rested against the grip wheel 33. The indentation 53 is positioned along the press plate 51 opposite of the connecting rod 52, where the indentation 53 is oppositely positioned from the first end. Since the press plate 51 is naturally positioned adjacent to the right inner plate 16 and the chartaceous objects is inserted into the front chamber 2 through the opening, the users need to pull the press plate 51 back toward the left inner plate 14 so that the chartaceous objects can be inserted. Once the press plate 51 is released by the users, the press plate 51 goes back to its relaxed state and traps the chartaceous objects in between the press plate 51 and the grip wheel 33.

When the present invention is at the on-position, the motor 32 is powered by the battery power source 34 so that the grip wheel 33 can be rotated within the present invention. Since the grip wheel 33 is exposed into the front chamber 2 through the wheel opening 17 and the chartaceous objects are pressed against the grip wheel 33 by the retaining mechanism 5, the rotational force of the grip wheel 33 launches each of the chartaceous objects one by one. More specifically, the motor 32 rotates in the clockwise direction and also causes the grip wheel 33 to rotate in the clockwise direction. Then the friction between the grip wheel 33 and each of the chartaceous objects pulls out each of the chartaceous objects from the front chamber 2 and propels through the opening.

It is often difficult for one to physically throw paper bills towards the target area or the target object due to the low mass and high surface area of the paper bills. The drag experienced by the paper bills during flight causes many bills to fall short and become lost before reaching the target area or the target object. This becomes particularly difficult to address if the users are positioned far from the target area or the target object. The object of the present invention is to allow the users to launch the chartaceous objects over large distances onto the target area or the target object, where the concave outer surface 18 of the preferred embodiment enhances the distance that each of the chartaceous objects launches. More specifically, the concave outer surface 18 slightly bends each of the chartaceous objects along the middle of the chartaceous objects during the launching process in order to improve the aerodynamic features of the chartaceous objects. As a result, the slightly bent chartaceous objects are able to launch further compare to the flat chartaceous objects since drag experience by the bent chartaceous objects is lower than the drag experience by the flat chartaceous objects. In other words, the present invention is able to reduce the drag experience by the chartaceous objects through the outer concave surface 18 in order to increase the launching distance of the chartaceous objects.

Various embodiments of the present invention may vary based on the available selective firing modes for the toy firearm. For example, the paper bills may be launched one at a time in a semiautomatic firing mode. Alternatively, the paper bills may be launched continuously by holding down the trigger 4 to continuously rotate the motor 32 in a fully automatic firing mode. The front chamber 2 may hold a large number the chartaceous objects so that the present invention is able to rapidly launch the chartaceous objects in a short time span. The present invention may incorporate additional features such as an integrated lighting system that is embedded within the present invention to visually illustrate the on-position of the dispensing mechanism 3.

Although the invention has been explained in relation to its preferred embodiment, it is to be understood that many other possible modifications and variations can be made without departing from the spirit and scope of the invention as hereinafter claimed.

What is claimed is:

1. A toy firearm for dispensing chartaceous objects comprises:

a handgun-shaped casing;

a front chamber;

a dispensing mechanism;

a trigger;

a retaining mechanism;

the handgun-shaped casing comprises a left outer casing, a left inner plate, a right outer casing, and a right inner plate;

the left outer casing and the right outer casing each comprise a barrel portion and a handle portion;

the dispensing mechanism comprises an on/off switch, a motor, a grip wheel, and a battery power source;

a releasing mechanism comprises a press plate, an indentation, and a spring;

the front chamber traversing into the handgun-shaped casing;

the dispensing mechanism being positioned within the handgun-shaped casing, wherein the trigger selectively operates the dispensing mechanism in between an on-position and an off-position;

the retaining mechanism being adjacently positioned within the front chamber the right inner plate comprises a concave outer surface; and the concave outer surface being adjacently positioned with the left inner plate.

2. The toy firearm for dispensing chartaceous objects as claimed in claim 1 comprises:

the left inner plate being connected to the left outer casing;

the right inner plate being connected to the right outer casing;

the left outer casing being attached with the right outer casing; and the left inner plate being adjacently positioned with the right inner plate.

3. The toy firearm for dispensing chartaceous objects as claimed in claim 1 comprises:

the front chamber being positioned in between the left inner plate and the right inner plate;

the trigger being pivotally connected to the handle portion of the right outer casing and the left outer casing; and the trigger being centrally positioned in between the left outer casing and the right outer casing.

4. The toy firearm for dispensing chartaceous objects as claimed in claim 1 comprises:

the on/off switch being connected to the handle portion of the right outer casing;

the on/off switch being adjacently positioned to the trigger;

the battery power source being connected to the handle portion of the right outer casing;

the motor being connected to the barrel portion of the right outer casing;

the motor being positioned in between the right outer casing and the right inner plate;

the grip wheel being axially connected with the motor;

the grip wheel being extended into the front chamber through a wheel opening of the right inner plate; and the on/off switch, the motor, and the battery power source being electrically connected with each other.

5. The toy firearm for dispensing chartaceous objects as claimed in claim 1 comprises:

when the dispensing mechanism is in the on-position, the trigger is positioned flush with the handle portion of the left outer casing and the right outer casing; and the on/off switch being pressed by the trigger.

6. The toy firearm for dispensing chartaceous objects as claimed in claim 1 comprises:

when the dispensing mechanism is in the off-position, the trigger is extended from the handle portion of the left outer casing and the right outer casing; and the on/off switch being positioned away from the trigger.

7. The toy firearm for dispensing chartaceous objects as claimed in claim 1 comprises:

the press plate being hingedly connected with the left inner plate through a connecting rod;

the spring being perimetrically connected around the connecting rod;

a first end of the spring being adjacently extended along the press plate;

a second end of the spring being adjacently extended along the left inner plate;

the first end and the second end being positioned in between the press plate and the left inner plate;

the indentation being positioned on the press plate opposite of the connecting rod; and the indentation being oppositely positioned from the first end.

8. A toy firearm for dispensing chartaceous objects comprises:

a handgun-shaped casing;

a front chamber;

a dispensing mechanism;

a trigger;

a retaining mechanism;

the handgun-shaped casing comprises a left outer casing, a left inner plate, a right outer casing, and a right inner plate;

the left outer casing and the right outer casing each comprise a barrel portion and a handle portion;

the right inner plate comprises a concave outer surface;

the dispensing mechanism comprises an on/off switch, a motor, a grip wheel, and a battery power source;

a releasing mechanism comprises a press plate, an indentation, and a spring;

the left inner plate being connected to the left outer casing;

the right inner plate being connected to the right outer casing;

the left outer casing being attached with the right outer casing;

the left inner plate being adjacently positioned with the right inner plate;

the concave outer surface being adjacently positioned with the left inner plate;

the front chamber traversing into the handgun-shaped casing;

the dispensing mechanism being positioned within the handgun-shaped casing, wherein the trigger selectively operates the dispensing mechanism in between an on-position and an off-position; and the retaining mechanism being adjacently positioned within the front chamber.

9. The toy firearm for dispensing chartaceous objects as claimed in claim 8 comprises:

the front chamber being positioned in between the left inner plate and the right inner plate;

the trigger being pivotally connected to the handle portion of the right outer casing and the left outer casing; and the trigger being centrally positioned in between the left outer casing and the right outer casing.

10. The toy firearm for dispensing chartaceous objects as claimed in claim 8 comprises:

the on/off switch being connected to the handle portion of the right outer casing;

the on/off switch being adjacently positioned to the trigger;

the battery power source being connected to the handle portion of the right outer casing;

the motor being connected to the barrel portion of the right outer casing;

the motor being positioned in between the right outer casing and the right inner plate;

the grip wheel being axially connected with the motor;

the grip wheel being extended into the front chamber through a wheel opening of the right inner plate; and the on/off switch, the motor, and the battery power source being electrically connected with each other.

11. The toy firearm for dispensing chartaceous objects as claimed in claim 8 comprises:

when the dispensing mechanism is in the on-position, the trigger is positioned flush with the handle portion of the left outer casing and the right outer casing; and the on/off switch being pressed by the trigger.

12. The toy firearm for dispensing chartaceous objects as claimed in claim 8 comprises:

when the dispensing mechanism is in the off-position, the trigger is extended from the handle portion of the left outer casing and the right outer casing; and the on/off switch being positioned away from the trigger.

13. The toy firearm for dispensing chartaceous objects as claimed in claim 8 comprises:

the press plate being hingedly connected with the left inner plate through a connecting rod;

the spring being perimetrically connected around the connecting rod;

a first end of the spring being adjacently extended along the press plate;

a second end of the spring being adjacently extended along the left inner plate;

the first end and the second end being positioned in between the press plate and the left inner plate;

the indentation being positioned on the press plate opposite of the connecting rod; and the indentation being oppositely positioned from the first end.

14. A toy firearm for dispensing chartaceous objects comprises:

a handgun-shaped casing;

a front chamber;

a dispensing mechanism;

a trigger;

a retaining mechanism;

the handgun-shaped casing comprises a left outer casing, a left inner plate, a right outer casing, and a right inner plate;

the left outer casing and the right outer casing each comprise a barrel portion and a handle portion;

the right inner plate comprises a concave outer surface;

the dispensing mechanism comprises an on/off switch, a motor, a grip wheel, and a battery power source;

a releasing mechanism comprises a press plate, an indentation, and a spring;

the left inner plate being connected to the left outer casing;

the right inner plate being connected to the right outer casing;

the left outer casing being attached with the right outer casing;

the left inner plate being adjacently positioned with the right inner plate;

the concave outer surface being adjacently positioned with the left inner plate;

the front chamber being positioned in between the left inner plate and the right inner plate;

the trigger being pivotally connected to the handle portion of the right outer casing and the left outer casing;

the trigger being centrally positioned in between the left outer casing and the right outer casing;

the dispensing mechanism being positioned within the handgun-shaped casing, wherein the trigger selectively operates the dispensing mechanism in between an on-position and an off-position; and the retaining mechanism being adjacently positioned within the front chamber.

15. The toy firearm for dispensing chartaceous objects as claimed in claim 14 comprises:

the on/off switch being connected to the handle portion of the right outer casing;

the on/off switch being adjacently positioned to the trigger;

the battery power source being connected to the handle portion of the right outer casing;

the motor being connected to the barrel portion of the right outer casing;

the motor being positioned in between the right outer casing and the right inner plate;

the grip wheel being axially connected with the motor;

the grip wheel being extended into the front chamber through a wheel opening of the right inner plate; and the on/off switch, the motor, and the battery power source being electrically connected with each other.

16. The toy firearm for dispensing chartaceous objects as claimed in claim 14 comprises:

when the dispensing mechanism is in the on-position, the trigger is positioned flush with the handle portion of the left outer casing and the right outer casing; and the on/off switch being pressed by the trigger.

17. The toy firearm for dispensing chartaceous objects as claimed in claim 14 comprises:

when the dispensing mechanism is in the off-position, the trigger is extended from the handle portion of the left outer casing and the right outer casing; and the on/off switch being positioned away from the trigger.

18. The toy firearm for dispensing chartaceous objects as claimed in claim 14 comprises:

the press plate being hingedly connected with the left inner plate through a connecting rod;

the spring being perimetrically connected around the connecting rod;

a first end of the spring being adjacently extended along the press plate;

a second end of the spring being adjacently extended along the left inner plate;

the first end and the second end being positioned in between the press plate and the left inner plate;

the indentation being positioned on the press plate opposite of the connecting rod; and the indentation being oppositely positioned from the first end.

* * * * *